United States Patent [19]

Wirfelt

[11] Patent Number: 4,538,494

[45] Date of Patent: Sep. 3, 1985

[54] MEANS FOR ACTUATING THE THROTTLE OF A PIVOTABLY MOUNTED CHAIN SAW

[75] Inventor: Sven A. O. Wirfelt, N.-Liebersbach, Fed. Rep. of Germany

[73] Assignee: Sandvik AB, Sandviken, Sweden

[21] Appl. No.: 603,317

[22] Filed: Apr. 24, 1984

[30] Foreign Application Priority Data

Nov. 29, 1982 [SE] Sweden ..... 8206794

[51] Int. Cl.[3] ..... B27B 17/02

[52] U.S. Cl. ..... 83/796; 83/574; 83/788

[58] Field of Search ..... 83/574, 571, 788, 796; 30/381

[56] References Cited

U.S. PATENT DOCUMENTS

| | | | |
|---|---|---|---|
| 2,851,067 | 9/1958 | Greenslate | 83/574 X |
| 4,210,049 | 7/1980 | Gauthier | 83/788 X |
| 4,214,498 | 7/1980 | Zukas et al. | 83/574 X |
| 4,342,243 | 8/1982 | Porritt | 83/788 X |

*Primary Examiner*—Frank T. Yost

*Attorney, Agent, or Firm*—Burns, Doane, Swecker & Mathis

[57] ABSTRACT

A throttle actuating mechanism is employed in conjunction with a chain saw which has a trigger and is mounted for pivotal movement about a rotary axis from a rest position toward a workpiece. The mechanism includes a lever pivoted coaxially with the rotary axis of the chain saw and carrying an adjustable pin. The pin is engaged by the chain saw trigger when the chain saw is pivoted toward the workpiece, whereby the lever pivots in a first direction along with the lever. A spring yieldably opposes pivotal movement of the lever in the first direction, thereby causing the pin to actuate the trigger when the chain saw leaves its rest position. The lever engages a stop while pivoting in the opposite direction and before the chain saw reaches its rest position, whereby the trigger is deactivated when the chain saw is in its rest position.

7 Claims, 2 Drawing Figures

MEANS FOR ACTUATING THE THROTTLE OF A PIVOTABLY MOUNTED CHAIN SAW

In order to facilitate the operation of chain saws when cutting wood in short lengths several devices are known which serve to support the chain saw so that it can be operated without having to hold it with both hands. One such construction is shown in U.S. Pat. No. 4,214,498, where the chain saw is mounted on a movable support that can be mechanically moved with one hand towards the work piece. It is desirable that the chain saw in an inoperative position runs at idle speed but that the engine of the saw is speeded up as it is moved towards the work piece. The known devices, however, do not have the advantage of the combination of a simple and operationally reliable construction with the flexibility necessary to receive most of the commercially available chain saws.

Figure 2:
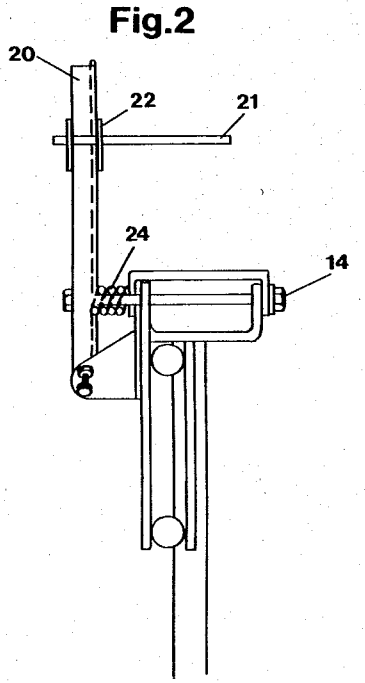
Figure 1:
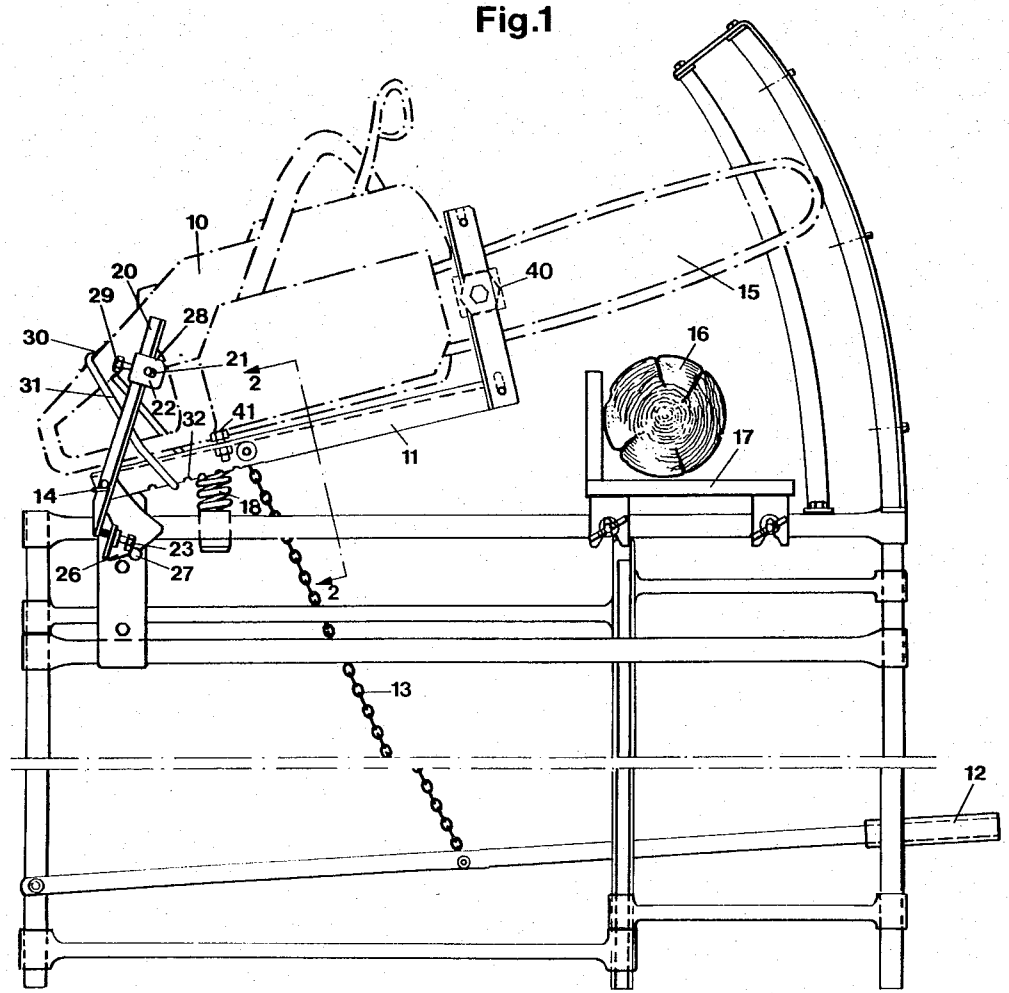

These and other difficulties experienced with the prior art devices have been obviated in a novel manner by means of a new type of spring-loaded lever adapted to actuate the trigger of the chain saw, which will become apparent with reference to the following description in conjuction with the drawings in which:

FIG. 1 is a side view of a wood cutting apparatus embodying the principles of the present invention, and FIG. 2 is a sectional view of the apparatus taken along the line II—II in FIG. 1.

Referring first to FIG. 1, wherein are shown the general features of the invention, a chain saw 10 is fastened to a cradle 11 by means of an elastic strap 31 and a clamping screw 40. The chain saw 10 rests upon a stop screw 41 in the cradle 11, said cradle 11 being pivotable on an axis 14 by downward movement of a pedal 12 connected to the cradle 11 via a chain 13. The saw bar 15 will then move towards the work piece 16 that is forwardly fed on a table 17 extending perpendicularly to the plane of the drawing. In rest position the cradle 11 is held in an upper position by means of a spring 18.

The throttle actuator consists of a lever 20 that is rotatably mounted on a protruding part of the axis 14. The upper part of the lever is provided with pin 21 held by a sliding bracket 22 which is adjustable to any position along the lever 20 and lockable with a screw 29. The pin 21 is arranged to abut the trigger 28 of the saw influencing it in a manner as described below. The lower part of the lever abuts an adjustment screw 23 and is held against the screw by means of a screw spring 24. The adjustment screw 23 runs through a bracket 26, which is rotatably mounted on the axis 14 and can be locked in a desired position on the frame by means of a locking screw 27. A coarse positioning of the lever 20 is made by rotation of the bracket 26 whereafter a fine adjustment can be made through the adjustment screw 23. As an alternative within the range of the invention the lever 20 and the bracket 26 may be mounted on another axis which is parallel with the axis 14 and situated in proximity to the axis 14. The bracket 26 may be slidable instead of being rotatably mounted.

The pin 21 will contact the trigger 28 of the saw 10 if the positioning devices are calibrated so that the saw runs free in the inoperative position but directly upon a pivoting movement towards the work piece 16 the pin 21 will force the trigger inwards thereby speeding up the engine of the saw. The spring 24 has to be sufficiently powerful to overcome the spring force of the trigger 28 of the saw. The safety switch 30 of the saw is inwardly forced by an elastic strap 31 or the like, which also serves to hold the saw 10 to the cradle 11 and therefore meshes with recesses 32 in the lower part of the cradle.

During the continued motion of the saw about the axis 14, the pin 21 will in due time force the trigger totally inwards whereupon the lever 20 leaves the adjustment screw 23 and follows the motion of the saw.

The device is simple to adjust and to lock because the pin 21 influencing the trigger is adjustable in radial and tangential direction relative to the centre of rotation 14. The lever being held against the screw 23 through the spring load will follow the movement of the saw when the trigger has been fully pressed in. These advantages will be kept substantially unchanged even if the lever 20 and the cradle 11 have somewhat spaced centres of rotation.

I claim:

1. A throttle actuating mechanism for use with a chain saw having a trigger and mounted for pivotal movement about an axis from a rest position toward a workpiece, said mechanism comprising:

a pivotally mounted lever having trigger engaging means oriented for engagement by the chain saw trigger in response to pivotal movement of the chain saw toward a workpiece, so that said lever is pivoted in a first direction along with the chain saw;

a spring yieldably opposing pivotal movement of said lever in said first direction to cause said trigger engaging means to act upon and actuate the chain saw trigger as the chain saw moves from said rest position and toward the workpiece, and stop means engageable with said lever to terminate movement of said lever in a direction opposite said first direction and prior to arrival of the chain saw in its rest position when pivoting away from the workpiece, so that the chain saw trigger is deactivated when the chain saw reaches its rest position.

2. Apparatus according to claim 1, wherein said stop means is adjustable within a pivotal path of said lever.

3. Apparatus according to claim 2, wherein said stop means comprises a screw.

4. Apparatus according to claim 1, wherein said trigger engaging means comprises a pin projecting from said lever in a direction parallel to said axis, said pin being adjustably movable along said lever, and locking means for locking said pin in various locations of adjustment along said lever.

5. Apparatus according to claim 1, wherein said lever is pivoted intermediate its ends, said trigger engaging means being disposed adjacent an upper end of said lever, and said stop means engaging a lower end of said lever.

6. Apparatus according to claim 1, wherein said lever is pivoted at a location closely proximate said axis.

7. Apparatus according to claim 6, wherein said lever is pivoted coaxially with said axis.

* * * * *